US008314056B2

(12) United States Patent
Sendor-Müller et al.

(10) Patent No.: US 8,314,056 B2
(45) Date of Patent: Nov. 20, 2012

(54) AUTOMATIC DISHWASHING AGENT

(75) Inventors: Dorota Sendor-Müller, Düsseldorf (DE); Johannes Zipfel, Düsseldorf (DE); Arnd Kessler, Monehim am Rhein (DE); Christian Nitsch, Düsseldorf (DE); Sven Müller, Duisburg (DE); Wolfgang Wick, Dormagen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/096,104

(22) Filed: Apr. 28, 2011

(65) Prior Publication Data

US 2011/0197927 A1 Aug. 18, 2011

Related U.S. Application Data

(63) Continuation of application No. PCT/EP2009/060070, filed on Aug. 4, 2009.

(30) Foreign Application Priority Data

Oct. 31, 2008 (DE) ..... 10 2008 054116
Dec. 18, 2008 (DE) ..... 10 2008 062773

(51) Int. Cl.
*C11D 17/00* (2006.01)

(52) U.S. Cl. ..... 510/220; 510/221; 510/223; 510/226; 510/229; 510/230; 134/25.2

(58) Field of Classification Search ..... 510/220, 510/221, 223, 226, 229, 230; 134/25.2
See application file for complete search history.

(56) References Cited

U.S. PATENT DOCUMENTS

| | | | | |
|---|---|---|---|---|
| 6,274,538 | B1 * | 8/2001 | Addison | 510/224 |
| 6,303,561 | B1 * | 10/2001 | Painter | 510/446 |
| 6,310,023 | B1 | 10/2001 | Kornaat et al. | |
| 6,358,911 | B1 * | 3/2002 | Metzger-Groom | 510/446 |
| 6,391,845 | B1 * | 5/2002 | Speed et al. | 510/446 |
| 6,399,564 | B1 * | 6/2002 | Speed et al. | 510/446 |
| 6,413,928 | B1 * | 7/2002 | Painter et al. | 510/446 |
| 6,440,927 | B1 * | 8/2002 | Painter et al. | 510/446 |
| 6,486,117 | B1 * | 11/2002 | Painter et al. | 510/446 |
| 6,770,616 | B1 * | 8/2004 | McGowan et al. | 510/446 |
| 6,974,789 | B1 * | 12/2005 | Whitaker et al. | 510/294 |
| 7,186,677 | B2 * | 3/2007 | Rahse et al. | 510/444 |
| 7,375,070 | B2 * | 5/2008 | Pegelow et al. | 510/296 |
| 2002/0160930 | A1 * | 10/2002 | Emmerson et al. | 510/445 |
| 2004/0063601 | A1 * | 4/2004 | Denome et al. | 510/407 |
| 2005/0020469 | A1 * | 1/2005 | Rahse et al. | 510/444 |
| 2005/0181962 | A1 * | 8/2005 | Pegelow et al. | 510/293 |
| 2005/0187136 | A1 * | 8/2005 | Pegelow et al. | 510/510 |
| 2005/0187137 | A1 * | 8/2005 | Pegelow et al. | 510/510 |
| 2007/0244024 | A1 * | 10/2007 | Barthel et al. | 510/445 |
| 2007/0287653 | A1 * | 12/2007 | Barthel et al. | 510/447 |
| 2008/0045441 | A1 * | 2/2008 | Schmiedel et al. | 510/514 |
| 2008/0248989 | A1 * | 10/2008 | Holderbaum et al. | 510/445 |

FOREIGN PATENT DOCUMENTS

| | | | |
|---|---|---|---|
| EP | 0 530 635 | B1 | 3/1993 |
| EP | 0 851 024 | A2 | 7/1998 |
| WO | WO 95/20030 | A1 | 7/1995 |
| WO | WO 2008/095554 | A2 | 8/2008 |

* cited by examiner

*Primary Examiner* — Gregory Webb
(74) *Attorney, Agent, or Firm* — Thomas G. Krivulka

(57) ABSTRACT

The invention relates to low-alkaline and bleach-free dishwasher detergents having a pH value (20° C.) between 8 and 12, comprising a) 10 to 60 wt % of citrate,
b) 1.5 to 30 wt % anionic copolymer, comprising
  i) unsaturated monocarboxylic acid(s) A
  ii) unsaturated dicarboxylic acid(s) B, characterized by good cleaning action, particularly improved cleaning of tea.

8 Claims, No Drawings

AUTOMATIC DISHWASHING AGENT

CROSS-REFERENCES TO RELATED APPLICATIONS

This is a continuation of International Application No. PCT/EP2009/060070, filed Aug. 4, 2009, which claims priority to German Patent Application No. DE102008054116.8, filed Oct. 31, 2008, and German Patent Application No. DE102008062773.9 filed Dec. 18, 2008, both of which are hereby incorporated by reference.

FIELD OF THE INVENTION

The present application describes automatic dishwashing agents, automatic dishwashing methods using these dishwashing agents and the use of these dishwashing agents for improving tea cleaning in automatic dishwashing.

BACKGROUND OF THE INVENTION

More stringent requirements are often applied to machine washed dishes than are applied to hand washed dishes. For instance, a dish which is at first glance completely clean of food residues is not deemed to be perfect if it still exhibits discoloration after automatic dishwashing which results for example from the deposition of vegetable dyes on the surface of the dish.

To achieve spotless dishes, bleaching agents are used in automatic dishwashing agents. To activate these bleaching agents and in order to achieve an improved bleaching action at temperatures of 60° C. and below, automatic dishwashing agents generally additionally contain bleach activators or bleach catalysts, bleach catalysts in particular having proven particularly effective.

Limits often apply to the use of these bleaching agents due to incompatibility with other ingredients with a washing or cleaning action, such as for example enzymes, or due to stability problems during the storage of washing and cleaning agents containing bleaching agents. This also applies in particular to liquid washing or cleaning agents.

One technical option for enhancing the cleaning performance of automatic dishwashing agents, in particular bleaching agent-free automatic dishwashing agents, is to increase the alkalinity of these agents. However, while on the one hand the cleaning performance of automatic dishwashing agents increases at higher levels of alkalinity, strongly alkaline cleaning products on the other hand also cause damage to the silicate structure of glasses and may trigger severe irritation on skin contact.

Alkali metal phosphates have proved to be particularly effective builders for increasing alkalinity, for which reason they form the main ingredient of the majority of commercially obtainable automatic dishwashing agents.

While phosphates are very highly regarded in terms of their advantageous action as a component of automatic dishwashing agents, their use is not entirely unproblematic from an environmental protection standpoint since a significant proportion of the phosphate passes with domestic wastewater into bodies of water and, especially in standing bodies of water (lakes, dams), plays a considerable part in their eutrophication or overfertilization. As a consequence of this phenomenon, the use of pentasodium triphosphate in textile washing agents has been considerably reduced by statutory regulations in quite a number of countries, for example the USA, Canada, Italy, Sweden, Norway, and has been entirely prohibited in Switzerland. In Germany, since 1984, the permitted maximum content of this builder in washing agents has been 20%.

From the user's standpoint and with regard to sustainable product development it is thus desirable to limit not only the alkalinity but also the phosphate content of automatic dishwashing agents.

The object underlying the present application was accordingly to provide cleaning agents for cleaning dishes which, in comparison with conventional agents for cleaning dishes, is distinguished by improved cleaning performance even in low temperature cleaning cycles or in cleaning cycles with low water consumption. In particular, the intention was for the agent for cleaning dishes, despite containing neither phosphate nor bleaching agent, to be distinguished by good cleaning performance, it being preferable to obtain improved cleaning performance, for example towards bleachable soiling, without simultaneously bringing about elevated damage to glass or ceramic surfaces. Bleachable soiling here includes, for example, soiling by tea or plant dyes for example from vegetables or fruit.

It has surprisingly been found that the above-stated object may be achieved by using specific polymers in a citrate-based base formulation. Other desirable features and characteristics of the present invention will become apparent from the subsequent detailed description of the invention and the appended claims, taken in conjunction with the accompanying drawings and this background of the invention.

BRIEF SUMMARY OF THE INVENTION

The present application firstly provides a low-alkali, phosphate- and bleaching agent-free automatic dishwashing agent with a pH value (10% solution; 20° C.) of between 8 and 12 comprising:

a) 10 to 60 wt. % of citrate b) 2.0 to 30 wt. % of anionic polymer comprising unsaturated dicarboxylic acid(s) B.

The automatic dishwashing agents according to the invention are low-alkali. Preferred automatic dishwashing agents according to the invention are characterized in that the automatic dishwashing agent exhibits a pH value (10% solution; 20° C.) of between 9 and 11.5, preferably between 9.5 and 11.5, in particular between 10.0 and 11.0.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

A first essential component of agents according to the invention is citrate. The term "citrate" here covers both citric acid and the salts thereof, in particular the alkali metal salts thereof. Particularly preferred automatic dishwashing agents according to the invention contain citrate, preferably sodium citrate, in quantities of 12 to 50 wt. %, preferably of 15 to 40 wt. % and in particular of 15 to 30 wt. %, in each case relative to the total weight of the automatic dishwashing agent. In comparison with other builders, citrate or citric acid in combination with the anionic copolymer have proved to be particularly active with regard to tea cleaning.

Some example formulations for preferred automatic dishwashing agents according to the invention may be found in Tables 1a and 1b below:

| Ingredient | Formulation 1a [wt. %] | Formulation 2a [wt. %] | Formulation 3a [wt. %] | Formulation 4a [wt. %] |
|---|---|---|---|---|
| Citrate | 12 to 50 | 15 to 40 | 12 to 50 | 15 to 40 |
| Anionic copolymer[1] | 2.0 to 30 | 2.0 to 30 | 1.5 to 30 | 1.5 to 30 |
| Silicate | —* | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 9 to 11.5 | |

| Ingredient | Formulation 1b [wt. %] | Formulation 2b [wt. %] | Formulation 3b [wt. %] | Formulation 4b [wt. %] |
|---|---|---|---|---|
| Citrate | 12 to 50 | 15 to 40 | 12 to 50 | 15 to 40 |
| Maleic acid homopolymer | 2.0 to 30 | 2.0 to 30 | 1.5 to 30 | 1.5 to 30 |
| Phosphate | —* | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 9 to 11.5 | 9 to 11.5 |

[1]Anionic copolymer, comprising unsaturated monocarboxylic acid(s) A and unsaturated dicarboxylic acid(s) B

*"—" means here, as in all following tables, that the formulation is free of this component As well as citrates, the automatic dishwashing agents according to the invention may contain additional builders, in particular carbonates or organic cobuilders.

It is particularly preferred to use carbonate(s) and/or hydrogencarbonate(s), preferably alkali metal carbonate(s), particularly preferably sodium carbonate, in quantities of 5 to 50 wt. %, preferably of 10 to 40 wt. % and in particular of 15 to 30 wt. %, in each case relative to the weight of the automatic dishwashing agent.

Preferred automatic dishwashing agents according to the invention are silicate-free.

Some example formulations for preferred automatic dishwashing agents according to the invention may be found in Tables 2a and 2b below:

| Ingredient | Formulation 1a [wt. %] | Formulation 2a [wt. %] | Formulation 3a [wt. %] | Formulation 4a [wt. %] |
|---|---|---|---|---|
| Citrate | 12 to 50 | 15 to 40 | 12 to 50 | 15 to 40 |
| Anionic copolymer[1] | 2.0 to 30 | 2.0 to 30 | 1.5 to 30 | 1.5 to 30 |
| Carbonate | 5 to 50 | 10 to 40 | 5 to 50 | 10 to 40 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 9 to 11.5 | 9 to 11.5 |

| Ingredient | Formulation 1b [wt. %] | Formulation 2b [wt. %] | Formulation 3b [wt. %] | Formulation 4b [wt. %] |
|---|---|---|---|---|
| Citrate | 12 to 50 | 15 to 40 | 12 to 50 | 15 to 40 |
| Maleic acid homopolymer | 2.0 to 30 | 2.0 to 30 | 1.5 to 30 | 1.5 to 30 |
| Carbonate | 5 to 50 | 10 to 40 | 5 to 50 | 10 to 40 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 9 to 11.5 | 9 to 11.5 |

[1]Anionic copolymer, comprising unsaturated monocarboxylic acid(s) A and unsaturated dicarboxylic acid(s) B Polycarboxylates/polycarboxylic acids, dextrins and phosphonates may in particular be mentioned as organic cobuilders. These classes of substances are described below.

Usable organic builder materials are for example polycarboxylic acids usable in the form of the free acid and/or the sodium salts thereof, polycarboxylic acids being taken to mean those carboxylic acids which bear more than one acid function. Examples are adipic acid, succinic acid, glutaric acid, malic acid, tartaric acid, maleic acid, fumaric acid, saccharic acids, aminocarboxylic acids, nitrilotriacetic acid (NTA), provided that there are no environmental objections against such use, and mixtures of these. Apart from their builder action, the free acids typically also have the property of an acidifying component and so also serve to establish a lower and gentler pH value for washing or cleaning agents. Succinic acid, glutaric acid, adipic acid, gluconic acid and any desired mixtures of these may in particular be mentioned.

In addition to 1 hydroxyethane-1,1-diphosphonic acid, the complexing phosphonates comprise a series of different compounds such as for example diethylenetriaminepenta(methylenephosphonic acid) (DTPMP). Hydroxyalkane- or aminoalkanephosphonates in particular are preferred in the present application. Among hydroxyalkanephosphonates, 1 hydroxyethane-1,1-diphosphonate (HEDP) is of particular significance as a cobuilder. It is preferably used as a sodium salt, the disodium salt exhibiting a neutral reaction and the tetrasodium salt an alkaline (pH 9) reaction. Aminoalkanephosphonates which may preferably be considered are ethylenediaminetetramethylenephosphonate (EDTMP), diethylenetriamine¬penta¬methylenephosphonate (DTPMP) as well as the higher homologs thereof. They are preferably used in the form of the sodium salts which exhibit a neutral reaction, for example as the hexasodium salt of EDTMP or as the hepta- and octasodium salt of DTPMP. From the class of phosphonates, HEDP is here preferably used as a builder. Aminoalkanephosphonates furthermore exhibit a pronounced heavy metal binding capacity. It may accordingly be preferred, especially if the agents also contain bleach, to use aminoalkanephosphonates, in particular DTPMP, or mixtures of the stated phosphonates.

An automatic dishwashing agent which is preferred for the purposes of the present application contains one or more phosphonate(s) from the group a) aminotrimethylenephosphonic acid (ATMP) and/or the salts thereof;
b) ethylenediaminetetra(methylenephosphonic acid) (EDTMP) and/or the salts thereof;
c) diethylenetriaminepenta(methylenephosphonic acid) (DTPMP) and/or the salts thereof;

d) 1 hydroxyethane-1,1-diphosphonic acid (HEDP) and/or the salts thereof;

e) 2 phosphonobutane-1,2,4-tricarboxylic acid (PBTC) and/or the salts thereof;

f) hexamethylenediaminetetra(methylenephosphonic acid) (HDTMP) and/or the salts thereof;

g) nitrilotri(methylenephosphonic acid) (NTMP) and/or the salts thereof.

Particularly preferred automatic dishwashing agents are those which contain 1 hydroxyethane-1,1-diphosphonic acid (HEDP) or diethylene¬triamine¬penta(methylenephosphonic acid) (DTPMP) as phosphonates.

The automatic dishwashing agents according to the invention may, of course, contain two or more different phosphonates.

The proportion by weight of phosphonates in the total weight of automatic dishwashing agents according to the invention preferably amounts to 1 to 8 wt. %, preferably to 1.2 to 6 wt. % and in particular to 1.5 to 4 wt. %.

Some example formulations for preferred automatic dishwashing agents according to the invention may be found in Tables 3a and 3b below:

| Ingredient | Formulation 1a [wt. %] | Formulation 2a [wt. %] | Formulation 3a [wt. %] | Formulation 4a [wt. %] |
|---|---|---|---|---|
| Citrate | 12 to 50 | 15 to 40 | 12 to 50 | 15 to 40 |
| Anionic copolymer[1] | 2.0 to 30 | 2.0 to 30 | 1.5 to 30 | 1.5 to 30 |
| Carbonate | 5 to 50 | 10 to 30 | 5 to 50 | 10 to 30 |
| Phosphonate | 1 to 8 | 1 to 8 | 1.2 to 6 | 1.2 to 6 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

| Ingredient | Formulation 1b [wt. %] | Formulation 2b [wt. %] | Formulation 3b [wt. %] | Formulation 4b [wt. %] |
|---|---|---|---|---|
| Citrate | 12 to 50 | 15 to 40 | 12 to 50 | 15 to 40 |
| Maleic acid homopolymer | 2.0 to 30 | 2.0 to 30 | 1.5 to 30 | 1.5 to 30 |
| Carbonate | 5 to 50 | 10 to 30 | 5 to 50 | 10 to 30 |
| Phosphonate | 1 to 8 | 1 to 8 | 1.2 to 6 | 1.2 to 6 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

[1]Anionic copolymer, comprising unsaturated monocarboxylic acid(s) A and unsaturated dicarboxylic acid(s) B A second essential component of agents according to the invention is the anionic polymer b) comprising unsaturated dicarboxylic acid(s) B. In a first preferred embodiment, this anionic polymer is an anionic copolymer comprising unsaturated mono- and dicarboxylic acids.

The present application further preferably provides a low-alkali, phosphate-, silicate- and bleaching agent-free automatic dishwashing agent with a pH value (10% solution; 20° C.) of between 8 and 12 containing:

a) 10 to 60 wt. % of citrate b) 1.5 to 30 wt. % of anionic copolymer comprising i) unsaturated monocarboxylic acid(s) A ii) unsaturated dicarboxylic acid(s) B.

Using the anionic copolymer b), comprising unsaturated monocarboxylic acid(s) A and unsaturated dicarboxylic acid(s) B has, with regard to the tea cleaning achieved with the agents according to the invention, proved to be superior to simple homopolymers of unsaturated monocarboxylic acids or copolymers of unsaturated monocarboxylic acids with monomers other than the unsaturated dicarboxylic acid.

Preferred automatic dishwashing agents according to the invention are characterized in that the automatic dishwashing agent contains as anionic polymer b) a copolymer comprising i) 50 to 90 wt. % of unsaturated monocarboxylic acid(s) A ii) 10 to 50 wt. % of unsaturated dicarboxylic acid(s) B.

Copolymers of acrylic acid or methacrylic acid with maleic acid are in particular suitable. Copolymers of acrylic acid with maleic acid have proven particularly suitable, preferred copolymers containing 50 to 90 wt. % of acrylic acid and 50 to 10 wt. % of maleic acid. Relative molecular mass, relative to free acids, amounts in general to 2000 to 70000 g/mol, preferably 20000 to 50000 g/mol and in particular 30000 to 40000 g/mol.

Preferred automatic dishwashing agents according to the invention are characterized in that the automatic dishwashing agent contains as anionic polymer b) a copolymer comprising i) 50 to 90 wt. % of acrylic acid ii) 10 to 50 wt. % of maleic acid.

Alternatively to the previously described copolymers comprising unsaturated mono- and dicarboxylic acids, it is also possible to use homopolymers of dicarboxylic acids as anionic polymers b), homopolymers of maleic acid being particularly preferred.

The present application further preferably provides a low-alkali, phosphate- and bleaching agent-free automatic dishwashing agent with a pH value (10% solution; 20° C.) of between 8 and 12 containing:

a) 10 to 60 wt. % of citrate b) 2.0 to 30 wt. % of maleic acid homopolymer.

The relative molecular mass of preferred maleic acid homopolymers amounts, relative to free acids, to between 2000 and 70000 g/mol, preferably 4000 to 50000 g/mol and in particular 6000 to 40000 g/mol.

The anionic copolymers b) may be used in the automatic dishwashing agents according to the invention for example as a powder or as an aqueous solution.

The proportion by weight of the anionic polymer b) in the total weight of automatic dishwashing agents according to the invention preferably amounts to 2.0 to 20 wt. %, preferably to 2.5 to 15 wt. % and in particular to 2.5 to 10 wt. %.

Some example formulations for preferred automatic dishwashing agents according to the invention may be found in Tables 4a to 4d below:

| Ingredient | Formulation 1a [wt. %] | Formulation 2a [wt. %] | Formulation 3a [wt. %] | Formulation 4a [wt. %] |
|---|---|---|---|---|
| Citrate | 12 to 50 | 15 to 40 | 12 to 50 | 15 to 40 |
| Anionic copolymer[1] | 2.0 to 20 | 2.0 to 20 | 2.5 to 10 | 2.5 to 10 |
| Carbonate | 0 to 50 | 0 to 30 | 0 to 30 | 0 to 30 |
| Phosphonate | 0 to 8 | 0 to 8 | 0 to 8 | 0 to 8 |
| Silicate | — | — | — | — |
| Phosphate | — | — | — | — |

-continued

| Ingredient | Formulation 1a [wt. %] | Formulation 2a [wt. %] | Formulation 3a [wt. %] | Formulation 4a [wt. %] |
|---|---|---|---|---|
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

| Ingredient | Formulation 1b [wt. %] | Formulation 2b [wt. %] | Formulation 3b [wt. %] | Formulation 4b [wt. %] |
|---|---|---|---|---|
| Citrate | 12 to 50 | 15 to 40 | 12 to 50 | 15 to 40 |
| Anionic copolymer1 | 2.0 to 20 | 2.0 to 20 | 2.5 to 10 | 2.5 to 10 |
| Carbonate | 5 to 50 | 10 to 30 | 5 to 50 | 10 to 30 |
| Phosphonate | 1 to 8 | 1 to 8 | 1.2 to 6 | 1.2 to 6 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

[1]anionic polymer b) a copolymer comprising 50 to 90 wt. % of acrylic acid and 10 to 50 wt. % of maleic acid

| Ingredient | Formulation 1c [wt. %] | Formulation 2c [wt. %] | Formulation 3c [wt. %] | Formulation 4c [wt. %] |
|---|---|---|---|---|
| Citrate | 12 to 50 | 15 to 40 | 12 to 50 | 15 to 40 |
| Maleic acid homopolymer | 2.0 to 20 | 2.0 to 20 | 2.5 to 10 | 2.5 to 10 |
| Carbonate | 0 to 50 | 0 to 30 | 0 to 30 | 0 to 30 |
| Phosphonate | 0 to 8 | 0 to 8 | 0 to 8 | 0 to 8 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

| Ingredient | Formulation 1d [wt. %] | Formulation 2d [wt. %] | Formulation 3d [wt. %] | Formulation 4d [wt. %] |
|---|---|---|---|---|
| Citrate | 12 to 50 | 15 to 40 | 12 to 50 | 15 to 40 |
| Maleic acid homopolymer | 2.0 to 20 | 2.0 to 20 | 2.5 to 10 | 2.5 to 10 |
| Carbonate | 5 to 50 | 10 to 30 | 5 to 50 | 10 to 30 |
| Phosphonate | 1 to 8 | 1 to 8 | 1.2 to 6 | 1.2 to 6 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

In addition to the previously described ingredients, the agents according to the invention may contain further substances with a washing or cleaning action, preferably from the group of surfactants, enzymes, organic solvents, glass corrosion inhibitors, corrosion inhibitors, scents and perfume carriers. These preferred ingredients are described in greater detail below.

Any nonionic surfactants known to a person skilled in the art may in principle be used as the nonionic surfactants. Examples of suitable nonionic surfactants are alkyl glycosides of the general formula RO(G)x, in which R corresponds to a primary straight-chain or methyl-branched aliphatic residue, in particular methyl-branched in position 2, with 8 to 22, preferably 12 to 18 C atoms and G is the symbol which denotes a glycose unit with 5 or 6 C atoms, preferably glucose. The degree of oligomerization x, which indicates the distribution of monoglycosides and oligoglycosides, is any desired number between 1 and 10; x is preferably 1.2 to 1.4.

Nonionic surfactants of the amine oxide type, for example N coconut alkyl-N,N-dimethylamine oxide and N tallow alcohol-N,N dihydroxyethylamine oxide, and of the fatty acid alkanolamide type may also be suitable. The quantity of these nonionic surfactants preferably amounts to no more than that of the ethoxylated fatty alcohols, in particular no more than half the quantity thereof.

A further class of preferably used nonionic surfactants, which may be used either as sole nonionic surfactant or in combination with other nonionic surfactants, are alkoxylated, preferably ethoxylated or ethoxylated and propoxylated fatty acid alkyl esters, preferably with 1 to 4 carbon atoms in the alkyl chain.

Low-foaming nonionic surfactants are used as preferred surfactants. Washing or cleaning agents, in particular cleaning agents for machine dishwashing, particularly preferentially contain nonionic surfactants from the group of alkoxylated alcohols. Alkoxylated, advantageously ethoxylated, in particular primary alcohols with preferably 8 to 18 C atoms and on average 1 to 12 mol of ethylene oxide (EO) per mol of alcohol, in which the alcohol residue may be linear or preferably methyl-branched in position 2 or may contain linear and methyl-branched residues in the mixture, as are usually present in oxo alcohol residues, are preferably used as nonionic surfactants. In particular, however, alcohol ethoxylates with linear residues prepared from alcohols of natural origin with 12 to 18 C atoms, for example from coconut, palm, tallow fat or oleyl alcohol, and on average 2 to 8 mol of EO per mol of alcohol are preferred. Preferred ethoxylated alcohols include, for example, C12 14 alcohols with 3 EO or 4 EO, C9 11 alcohol with 7 EO, C13 15 alcohols with 3 EO, 5 EO, 7 EO or 8 EO, C12 18 alcohols with 3 EO, 5 EO or 7 EO and mixtures of these, such as mixtures of C12 14 alcohol with 3 EO and C12-18 alcohol with 5 EO. The stated degrees of ethoxylation are statistical averages which, for a specific product, may be an integer or a fractional number. Preferred alcohol ethoxylates have a narrow homolog distribution (narrow range ethoxylates, NRE). In addition to these nonionic surfactants, fatty alcohols with more than 12 EO may also be used. Examples of these are tallow fatty alcohol with 14 EO, 25 EO, 30 EO or 40 EO.

Ethoxylated nonionic surfactants which were obtained from $C_{6-20}$ monohydroxyalkanols or $C_{6-20}$ alkylphenols or $Cl_{6-20}$ fatty alcohols and more than 12 mol, preferably more than 15 mol and in particular more than 20 mol of ethylene oxide per mol of alcohol are accordingly particularly preferentially used. One particularly preferred nonionic surfactant is obtained from a straight-chain fatty alcohol having 16 to 20 carbon atoms ($C_{6-20}$ alcohol), preferably a $C_{18}$ alcohol, and at least 12 mol, preferably at least 15 mol and in particular at least 20 mol of ethylene oxide. Among these, "narrow range ethoxylates" are particularly preferred.

In particular, nonionic surfactants having a melting point of above room temperature are preferred. Nonionic surfactant(s) with a melting point of above 20° C., preferably of above 25° C., particularly preferably of between 25 and 60° C. and in particular of between 26.6 and 43.3° C., is/are particularly preferred.

Nonionic surfactants from the group of alkoxylated alcohols, particularly preferably from the group of mixed alkoxylated alcohols and in particular from the group of EO-AO-EO nonionic surfactants, are likewise particularly preferentially used.

The nonionic surfactant which is solid at room temperature preferably comprises propylene oxide units in its molecule. Such PO units preferably constitute up to 25 wt. %, particularly preferably up to 20 wt. % and in particular up to 15 wt. % of the total molar mass of the nonionic surfactant. Particularly preferred nonionic surfactants are ethoxylated monohydroxyalkanols or alkylphenols which additionally comprise polyoxyethylene/polyoxypropylene block copolymer units. The alcohol or alkylphenol moiety of such nonionic surfactant molecules here preferably constitutes more than 30 wt. %, particularly preferably more than 50 wt. % and in particular more than 70 wt. % of the total molar mass of such nonionic surfactants. Preferred agents are characterized in that they contain ethoxylated and propoxylated nonionic surfactants, in which the propylene oxide units constitute in each molecule up to 25 wt. %, preferably up to 20 wt. % and in particular up to 15 wt. % of the entire molar mass of the nonionic surfactant.

Preferably used surfactants originate from the groups comprising alkoxylated nonionic surfactants, in particular ethoxylated primary alcohols and mixtures of these surfactants with structurally complex surfactants such as polyoxypropylene/polyoxyethylene/polyoxypropylene ((PO/EO/PO) surfactants). Such (PO/EO/PO) nonionic surfactants are furthermore distinguished by good foam control.

Further nonionic surfactants with a melting point above room temperature which are particularly preferably to be used contain 40 to 70% of a polyoxypropylene/polyoxyethylene/polyoxypropylene block polymer blend, which contains 75 wt. % of a reverse block copolymer of polyoxyethylene and polyoxypropylene with 17 mol of ethylene oxide and 44 mol of propylene oxide and 25 wt. % of a block copolymer of polyoxyethylene and polyoxypropylene, initiated with trimethylolpropane and containing 24 mol of ethylene oxide and 99 mol of propylene oxide per mol of trimethylolpropane.

Nonionic surfactants which have proved to be particularly preferred for the purposes of the present invention are low-foaming nonionic surfactants which comprise alternating ethylene oxide and alkylene oxide units. Among these, surfactants with EO-AO-EO-AO blocks are in turn preferred, with in each case one to ten EO or AO groups being attached to one another before being followed by a block of the respective other groups. Preferred nonionic surfactants are those of the general formula

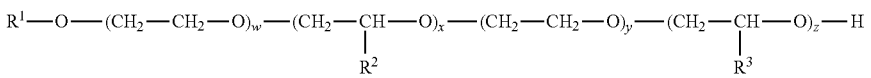

in which $R^1$ denotes a straight-chain or branched, saturated or mono- or polyunsaturated $C_{6-24}$ alkyl or alkenyl residue; each group $R^2$ or $R^3$ is mutually independently selected from $CH_3$, $CH_2CH_3$, $CH_2CH_2CH_3$, $CH(CH_3)_2$ and the indices w, x, y, z mutually independently denote integers from 1 to 6.

The preferred nonionic surfactants of the above formula may be produced by known methods from the corresponding alcohols $R^1OH$ and ethylene or alkylene oxide. Residue $R^1$ in the above formula may vary depending on the origin of the alcohol. If natural sources are used, the residue $R^1$ comprises an even number of carbon atoms and is generally unbranched, preference being given to linear residues from alcohols of natural origin with 12 to 18 C atoms, for example from coconut, palm, tallow fat or oleyl alcohol. Alcohols obtainable from synthetic sources are for example Guerbet alcohols or residues methyl-branched in position 2 or linear and methyl-branched residues in a mixture as are conventionally present in oxo alcohol residues. Irrespective of the nature of the alcohol used for producing nonionic surfactants contained in the agents, preferred nonionic surfactants are those in which $R^1$ in the above formula denotes an alkyl residue with 6 to 24, preferably 8 to 20, particularly preferably 9 to 15 and in particular 9 to 11 carbon atoms.

Apart from propylene oxide, butylene oxide may in particular be considered as the alkylene oxide unit which alternates with the ethylene oxide unit in preferred nonionic surfactants. Further alkylene oxides, in which $R^2$ or $R^3$ are mutually independently selected from $CH_2CH_2CH_3$ or $CH(CH_3)_2$, are however also suitable. Nonionic surfactants of the above formula which are preferably used are those in which $R^2$ or $R^3$ denotes a residue $CH_3$, w and x mutually independently denote values of 3 or 4 and y and z mutually independently denote values of 1 or 2.

In summary, preferred nonionic surfactants are in particular those which comprise a $C_{9-15}$ alkyl residue with 1 to 4 ethylene oxide units, followed by 1 to 4 propylene oxide units, followed by 1 to 4 ethylene oxide units, followed by 1 to 4 propylene oxide units. In aqueous solution, these surfactants exhibit the necessary low viscosity and may particularly preferentially be used according to the invention.

Surfactants of the general formula $R^1CH(OH)CH_2O(AO)_w(A'O)_x(A''O)_y(A'''O)_zR^2$, in which $R^1$ and $R^2$ mutually independently denote a straight-chain or branched, saturated or mono- or polyunsaturated $C_{2-40}$ alkyl or alkenyl residue; A, A', A'' and A'''mutually independently denote a residue from the group $CH_2CH_2$, $CH_2CH_2CH_2$, $CH_2CH(CH_3)$, $CH_2CH_2CH_2CH_2$, $CH_2CH(CH_3)CH_2$—, $CH_2CH(CH_2CH_3)$; and w, x, y and z denote values between 0.5 and 90, with x, y and/or z possibly also being 0, are preferred according to the invention.

In particular, preferred end group-terminated poly(oxyalkylated) nonionic surfactants are those which, according to the formula $R^1O[CH_2CH_2O]_xCH_2CH(OH)R^2$, in addition to a residue $R^1$, which denotes linear or branched, saturated or unsaturated, aliphatic or aromatic hydrocarbon residues with 2 to 30 carbon atoms, preferably with 4 to 22 carbon atoms, furthermore comprise a linear or branched, saturated or unsaturated, aliphatic or aromatic hydrocarbon residue $R^2$ with 1 to 30 carbon atoms, x denoting values between 1 and 90, preferably values between 30 and 80 and in particular values between 30 and 60.

Particularly preferred surfactants are those of the formula $R^1O[CH_2CH(CH_3)O]_x[CH_2CH_2O]_yCH_2CH(OH)R^2$, in which $R^1$ denotes a linear or branched aliphatic hydrocarbon residue with 4 to 18 carbon atoms or mixtures thereof, $R^2$ denotes a linear or branched hydrocarbon residue with 2 to 26 carbon atoms or mixtures thereof and x denotes values between 0.5 and 1.5 and y denotes a value of at least 15.

Particularly preferred end group-terminated poly(oxyalkylated) nonionic surfactants are furthermore those of the formula $R^1O[CH_2CH_2O]_x[CH_2CH(R^3)O]_yCH_2CH(OH)R^2$, in which $R^1$ and $R^2$ mutually independently denote a linear or branched, saturated or mono- or polyunsaturated hydrocarbon residue with 2 to 26 carbon atoms, $R^3$ is mutually independently selected from $CH_3$, $CH_2CH_3$, $CH_2CH_2CH_3$, $CH(CH_3)_2$, but preferably denotes $CH_3$, and x and y mutually independently denote values between 1 and 32, with nonionic surfactants with $R^3$=$CH_3$ and values of x from 15 to 32 and y from 0.5 and 1.5 being very particularly preferred.

Thanks to the use of the above-described nonionic surfactants with a free hydroxyl group on one of the two terminal alkyl residues, it is possible to achieve a distinct improvement in the formation of film deposits in automatic dishwashing in comparison with conventional polyalkoxylated fatty alcohols without a free hydroxyl group.

Further preferably usable nonionic surfactants are the end group-terminated poly(oxyalkylated) nonionic surfactants of the formula $R^1O[CH_2CH(R^3)O]_x[CH_2]_kCH(OH)[CH_2]_jOR^2$, in which $R^1$ and $R^2$ denote linear or branched, saturated or unsaturated, aliphatic or aromatic hydrocarbon residues with 1 to 30 carbon atoms, $R^3$ denotes H or a methyl, ethyl, n propyl, isopropyl, n butyl, 2 butyl or 2 methyl-2 butyl residue, x denotes values between 1 and 30, k and j denote values between 1 and 12, preferably between 1 and 5. If the value of x is ≧2, each R3 in the above formula $R^1O[CH_2CH(R^3)O]_x[CH_2]_kCH(OH)[CH_2]_jOR^2$ may be different. R1 and R2 are preferably linear or branched, saturated or unsaturated, aliphatic or aromatic hydrocarbon residues with 6 to 22 carbon atoms, residues with 8 to 18 C atoms being particularly preferred. H, —CH3 or —CH2CH3 are particularly preferred for the residue R3. Particularly preferred values for x are in the range from 1 to 20, in particular of 6 to 15.

As described above, each $R^3$ in the above formula may be different if x is ≧2. In this manner, it is possible to vary the alkylene oxide unit in the square brackets. For example, if x denotes 3, the residue $R^3$ may be selected in order to form ethylene oxide ($R^3$=H) or propylene oxide ($R^3$=$CH_3$) units, which may be attached to one another in any sequence, for example (EO)(PO)(EO), (EO)(EO)(PO), (EO)(EO)(EO), (PO)(EO)(PO), (PO)(PO)(EO) and (PO)(PO)(PO). The value 3 for x has been selected here by way of example and may perfectly well be larger, the range of variation increasing as the value of x rises and for example comprising a large number of (EO) groups combined with a small number of (PO) groups, or vice versa.

Particularly preferred end group-terminated poly(oxyalkylated) alcohols of the above-stated formula have values of k=1 and j=1, so simplifying the above formula to $R^1O[CH_2CH(R^3)O]_xCH_2CH(OH)CH_2OR^2$. In the latter-stated formula, $R^1$, $R^2$ and $R^3$ are as defined above and x denotes numbers from 1 to 30, preferably from 1 to 20 and in particular from 6 to 18. Particularly preferred surfactants are those in which the residues $R^1$ and $R^2$ comprise 9 to 14 C atoms, $R^3$ denotes H and x assumes values from 6 to 15.

The stated C chain lengths and degrees of ethoxylation or degrees of alkoxylation of the above-stated nonionic surfactants are statistical averages which, for a specific product, may be an integer or a fractional number. Due to production methods, commercial products of the stated formulae do not in the main consist of an individual representative, but instead of mixtures, whereby not only the C-chain lengths but also the degrees of ethoxylation or degrees of alkoxylation may be averages and consequently fractional numbers.

The above-stated nonionic surfactants may, of course, be used not only as individual substances, but also as surfactant mixtures of two, three, four or more surfactants. Surfactant mixtures do not here comprise mixtures of nonionic surfactants all of which fall within one of the above-stated general formulae, but instead such mixtures which contain two, three, four or more nonionic surfactants which may be described by various of the above-stated general formulae.

The proportion by weight of the nonionic surfactant in the total weight of the automatic dishwashing agent according to the invention amounts in a preferred embodiment to between 0.1 and 15 wt. %, preferably between 0.2 and 10 wt. %, preferably between 0.5 and 8 wt. % and in particular between 1.0 and 6 wt. %.

Some example formulations for preferred automatic dishwashing agents according to the invention may be found in Tables 5a to 5d below:

| Ingredient | Formulation 1a [wt. %] | Formulation 2a [wt. %] | Formulation 3a [wt. %] | Formulation 4a [wt. %] |
|---|---|---|---|---|
| Citrate | 12 to 50 | 15 to 40 | 12 to 50 | 15 to 40 |
| Anionic copolymer[1] | 2.0 to 20 | 2.0 to 20 | 2.5 to 10 | 2.5 to 10 |
| Carbonate | 0 to 50 | 0 to 30 | 0 to 30 | 0 to 30 |
| Phosphonate | 0 to 8 | 0 to 8 | 0 to 8 | 0 to 8 |
| Nonionic surfactant | 0.1 to 15 | 0.1 to 15 | 0.5 to 8 | 0.5 to 8 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

| Ingredient | Formulation 1b [wt. %] | Formulation 2b [wt. %] | Formulation 3b [wt. %] | Formulation 4b [wt. %] |
|---|---|---|---|---|
| Citrate | 12 to 50 | 15 to 40 | 12 to 50 | 15 to 40 |
| Anionic copolymer[1] | 2.0 to 20 | 2.0 to 20 | 2.5 to 10 | 2.5 to 10 |

-continued

| Ingredient | Formulation 1b [wt. %] | Formulation 2b [wt. %] | Formulation 3b [wt. %] | Formulation 4b [wt. %] |
|---|---|---|---|---|
| Carbonate | 5 to 50 | 10 to 30 | 5 to 50 | 10 to 30 |
| Phosphonate | 1 to 8 | 1 to 8 | 1.2 to 6 | 1.2 to 6 |
| Nonionic surfactant | 0.1 to 15 | 0.1 to 15 | 0.5 to 8 | 0.5 to 8 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

[1]anionic polymer b) a copolymer comprising 50 to 90 wt. % of acrylic acid and 10 to 50 wt. % of maleic acid

| Ingredient | Formulation 1c [wt. %] | Formulation 2c [wt. %] | Formulation 3c [wt. %] | Formulation 4c [wt. %] |
|---|---|---|---|---|
| Citrate | 12 to 50 | 15 to 40 | 12 to 50 | 15 to 40 |
| Maleic acid homopolymer | 2.0 to 20 | 2.0 to 20 | 2.5 to 10 | 2.5 to 10 |
| Carbonate | 0 to 50 | 0 to 30 | 0 to 30 | 0 to 30 |
| Phosphonate | 0 to 8 | 0 to 8 | 0 to 8 | 0 to 8 |
| Nonionic surfactant | 0.1 to 15 | 0.1 to 15 | 0.5 to 8 | 0.5 to 8 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

| Ingredient | Formulation 1d [wt. %] | Formulation 2d [wt. %] | Formulation 3d [wt. %] | Formulation 4d [wt. %] |
|---|---|---|---|---|
| Citrate | 12 to 50 | 15 to 40 | 12 to 50 | 15 to 40 |
| Maleic acid homopolymer | 2.0 to 20 | 2.0 to 20 | 2.5 to 10 | 2.5 to 10 |
| Carbonate | 5 to 50 | 10 to 30 | 5 to 50 | 10 to 30 |
| Phosphonate | 1 to 8 | 1 to 8 | 1.2 to 6 | 1.2 to 6 |
| Nonionic surfactant | 0.1 to 15 | 0.1 to 15 | 0.5 to 8 | 0.5 to 8 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

Dishwashing agents according to the invention may contain enzyme(s) as a further component. These include in particular proteases, amylases, lipases, hemicellulases, cellulases, perhydrolases or oxidoreductases, and preferably mixtures thereof. These enzymes are in principle of natural origin; starting from the natural molecules, improved variants are available for use in washing or cleaning agents, said variants accordingly preferably being used. Washing or cleaning agents preferably contain enzymes in total quantities of 1×10 6 to 5 wt. % relative to active protein. Protein concentration may be determined with the assistance of known methods, for example the BCA method or the biuret method.

Among proteases, those of the subtilisin type are preferred. Examples of these are subtilisins BPN' and Carlsberg and their further developed forms protease PB92, subtilisins 147 and 309, alkaline protease from *Bacillus lentus*, subtilisin DY and the enzymes thermitase, proteinase K and proteases TW3 and TW7, which are classed among subtilases but no longer among the subtilisins as more narrowly defined.

Examples of amylases usable according to the invention are the α amylases from *Bacillus licheniformis*, from *B. amyloliquefaciens*, from *B. stearothermophilus*, from *Aspergillus niger* and *A. oryzae* and the further developed forms of the above-stated amylases which have been improved for use in washing and cleaning agents. Particular note should furthermore be taken for this purpose of the α amylase from *Bacillus* sp. A 7-7 (DSM 12368) and the cyclodextrin glucanotransferase (CGTase) from *B. agaradherens* (DSM 9948).

Lipases or cutinases, in particular because of their triglyceride-cleaving activities, but also in order to produce peracids in situ from suitable precursors may furthermore be used according to the invention. These include, for example, lipases originally obtainable or further developed from *Humicola lanuginosa* (*Thermomyces lanuginosus*), in particular those with the D96L amino acid substitution.

Enzymes which fall within the class of hemicellulases may furthermore be used. These include, for example, mannanases, xanthan lyases, pectin lyases (=pectinases), pectin esterases, pectate lyases, xyloglucanases (=xylanases), pullulanases and β-glucanases.

Oxidoreductases, for example oxidases, oxygenases, catalases, peroxidases, such as halo-, chloro-, bromo-, lignin, glucose or manganese peroxidases, dioxygenases or laccases (phenol oxidases, polyphenol oxidases) may be used according to the invention to increase bleaching action. Compounds, preferably organic compounds, particularly preferably aromatic compounds, which interact with the enzymes are advantageously also added in order to enhance the activity of the oxidoreductases in question (enhancers) or, in the event of a major difference in redox potential between the oxidizing enzymes and the soiling, to ensure electron flow (mediators).

A protein and/or enzyme may be protected, particularly during storage, from damage such as for example inactivation, denaturation or degradation for instance due to physical influences, oxidation or proteolytic cleavage. If the proteins and/or enzymes are isolated from microbes, inhibition of proteolysis is particularly preferred, in particular if the agents also contain proteases. Washing or cleaning agents may contain stabilizers for this purpose; the provision of such agents constitutes a preferred embodiment of the present invention.

Proteases and amylases with a washing or cleaning action are not generally provided in the form of the pure protein but rather in the form of stabilized storable and transportable preparations. These preformulated preparations include, for example, solid preparations obtained by granulation, extrusion or freeze-drying or, in particular in the case of preparations in liquid or gel form, solutions of the enzymes, advantageously as concentrated as possible, with a low water content and/or combined with stabilizers or further auxiliaries.

Alternatively, both for the solid and the liquid presentation, the enzymes may be encapsulated, for example by spray drying or extruding the enzyme solution together with a preferably natural polymer or in the form of capsules, for example those in which the enzymes are enclosed for instance in a solidified gel or those of the core-shell type, in which an enzyme-containing core is coated with a protective layer which is impermeable to water, air and/or chemicals. Further active ingredients, for example stabilizers, emulsifiers, pigments, bleaching agents or dyes may additionally be applied in superimposed layers. Such capsules are applied in accordance with per se known methods, for example by agitated or rolling granulation or in fluidized bed processes. Advantageously, such granules are low-dusting, for example due to the application of polymeric film formers, and stable in storage thanks to the coating.

It is furthermore possible to formulate two or more enzymes together such that a single granular product comprises two or more enzyme activities.

A preferred automatic dishwashing agent according to the invention is characterized in that the dishwashing agent, relative to the total weight thereof, contains enzyme preparation(s) in quantities of 0.1 to 12 wt. %, preferably of 0.2 to 10 wt. % and in particular of 0.5 to 8 wt. %.

As is clear from the preceding explanations, the enzyme protein constitutes only a fraction of the total weight of conventional enzyme preparations. Protease and amylase preparations preferably used according to the invention contain between 0.1 and 40 wt. %, preferably between 0.2 and 30 wt. %, particularly preferably between 0.4 and 20 wt. % and in particular between 0.8 and 10 wt. % of the enzyme protein.

A particularly preferred automatic dishwashing agent according to the invention comprises a) 10 to 40 wt. % of citrate
b) 1.5 to 10 wt. % of anionic copolymer comprising
i) acrylic acid
ii) maleic acid
c) 1 to 8 wt. % of phosphonate
d) 0.2 to 10 wt. % of nonionic surfactant
e) 0.1 to 8 wt. % of enzyme preparation(s)

A further particularly preferred automatic dishwashing agent according to the invention comprises a) 10 to 40 wt. % of citrate
b) 1.5 to 10 wt. % of maleic acid homopolymer
c) 1 to 8 wt. % of phosphonate
d) 0.2 to 10 wt. % of nonionic surfactant
e) 0.1 to 8 wt. % of enzyme preparation(s)

Some further example formulations for preferred automatic dishwashing agents according to the invention may be found in Tables 6a to 6d below:

| Ingredient | Formulation 1a [wt. %] | Formulation 2a [wt. %] | Formulation 3a [wt. %] | Formulation 4a [wt. %] |
|---|---|---|---|---|
| Citrate | 12 to 50 | 15 to 40 | 12 to 50 | 15 to 40 |
| Anionic copolymer[1] | 2.0 to 20 | 2.0 to 20 | 2.5 to 10 | 2.5 to 10 |
| Carbonate | 0 to 50 | 0 to 30 | 0 to 30 | 0 to 30 |
| Phosphonate | 0 to 8 | 0 to 8 | 0 to 8 | 0 to 8 |
| Nonionic surfactant | 0 to 15 | 0 to 15 | 0 to 8 | 0 to 8 |
| Enzyme preparation(s) | 0.1 to 12 | 0.1 to 12 | 0.5 to 8 | 0.5 to 8 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

| Ingredient | Formulation 1b [wt. %] | Formulation 2b [wt. %] | Formulation 3b [wt. %] | Formulation 4b [wt. %] |
|---|---|---|---|---|
| Citrate | 12 to 50 | 15 to 40 | 12 to 50 | 15 to 40 |
| Anionic copolymer[1] | 2.0 to 20 | 2.0 to 20 | 2.5 to 10 | 2.5 to 10 |
| Carbonate | 5 to 50 | 10 to 30 | 5 to 50 | 10 to 30 |
| Phosphonate | 1 to 8 | 1 to 8 | 1.2 to 6 | 1.2 to 6 |
| Nonionic surfactant | 0.1 to 15 | 0.1 to 15 | 0.5 to 8 | 0.5 to 8 |
| Enzyme preparation(s) | 0.1 to 12 | 0.1 to 12 | 0.5 to 8 | 0.5 to 8 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

[1]anionic polymer b) a copolymer comprising 50 to 90 wt. % of acrylic acid and 10 to 50 wt. % of maleic acid

| Ingredient | Formulation 1c [wt. %] | Formulation 2c [wt. %] | Formulation 3c [wt. %] | Formulation 4c [wt. %] |
|---|---|---|---|---|
| Citrate | 12 to 50 | 15 to 40 | 12 to 50 | 15 to 40 |
| Maleic acid homopolymer | 2.0 to 20 | 2.0 to 20 | 2.5 to 10 | 2.5 to 10 |
| Carbonate | 0 to 50 | 0 to 30 | 0 to 30 | 0 to 30 |
| Phosphonate | 0 to 8 | 0 to 8 | 0 to 8 | 0 to 8 |
| Nonionic surfactant | 0 to 15 | 0 to 15 | 0 to 8 | 0 to 8 |
| Enzyme preparation(s) | 0.1 to 12 | 0.1 to 12 | 0.5 to 8 | 0.5 to 8 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

| Ingredient | Formulation 1d [wt. %] | Formulation 2d [wt. %] | Formulation 3d [wt. %] | Formulation 4d [wt. %] |
|---|---|---|---|---|
| Citrate | 12 to 50 | 15 to 40 | 12 to 50 | 15 to 40 |
| Maleic acid homopolymer | 2.0 to 20 | 2.0 to 20 | 2.5 to 10 | 2.5 to 10 |
| Carbonate | 5 to 50 | 10 to 30 | 5 to 50 | 10 to 30 |
| Phosphonate | 1 to 8 | 1 to 8 | 1.2 to 6 | 1.2 to 6 |
| Nonionic surfactant | 0.1 to 15 | 0.1 to 15 | 0.5 to 8 | 0.5 to 8 |
| Enzyme preparation(s) | 0.1 to 12 | 0.1 to 12 | 0.5 to 8 | 0.5 to 8 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

It has been found that the cleaning performance of automatic dishwashing agents according to the invention may be improved by the addition of organic solvents.

These organic solvents originate, for example, from the groups of mono alcohols, diols, triols or polyols, ethers, esters and/or amides. Particularly preferred organic solvents are those which are water-soluble, "water-soluble" solvents for the purposes of the present application being those solvents which are completely miscible, i.e. without a miscibility gap, with water at room temperature.

Organic solvents which may be used in the agents according to the invention preferably originate from the group of mono- or polyhydric alcohols, alkanolamines or glycol ethers, provided that they are water-miscible in the stated concentration range. The solvents are preferably selected from ethanol, n- or i-propanol, butanols, glycol, propanediol or butanediol, glycerol, diglycol, diethylene glycol butyl or propyl ether, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol methyl or ethyl ether, 1-butoxyethoxy-2-propanol, 3-methyl-3-methoxybutanol, propylene glycol-t-butyl ether and mixtures of these solvents.

Organic solvents from the group of organic amines and/or alkanolamines have proved to be particularly effective with regard to cleaning performance and specifically in terms of cleaning performance on bleachable soiling, in particular on tea stains.

Primary and secondary alkylamines, alkyleneamines and mixtures of these organic amines are particularly preferred as organic amines. The group of preferred primary alkylamines include monomethylamine, monoethylamine, monopropylamine, monobutylamine, monopentylamine and cyclohexylamine. The group of preferred secondary alkylamines includes in particular dimethylamine.

Preferred alkanolamines are in particular primary, secondary and tertiary alkanolamines and mixtures thereof. Particularly preferred primary alkanolamines are monoethanolamine (2 aminoethanol, MEA), monoisopropanolamine, diethylethanolamine (2 (diethylamino)-ethanol). Particularly preferred secondary alkanolamines are diethanolamine (2,2' iminodiethanol, DEA, bis(2-hydroxyethyl)amine), N methyl diethanolamine, N ethyl diethanolamine, diisopropanolamine and morpholine. Particularly preferred tertiary alkanolamines are triethanolamine and triisopropanolamine.

Combination products which are characterized in that they contain an organic solvent, the organic solvent being an organic amine and/or an alkanolamine, preferably monoethanolamine, are particularly preferred according to the invention.

The present application further provides an automatic dishwashing agent according to the invention which is characterized in that the automatic dishwashing agent, relative to the total weight thereof, contains organic amine and/or an alkanolamine, preferably ethanolamine, in quantities of 0.1 to 15 wt. %, preferably of 0.2 to 10 wt. %, particularly preferably of 0.5 to 8 wt. % and in particular of 1.0 to 6 wt. %.

These solvent-containing automatic dishwashing agents preferably assume liquid form.

A particularly preferred liquid automatic dishwashing agent according to the invention comprises a) 10 to 40 wt. % of citrate
b) 1.5 to 10 wt. % of anionic copolymer comprising
i) acrylic acid
ii) maleic acid
c) 1 to 8 wt. % of phosphonate
d) 0.1 to 6 wt. % of alkanolamine
e) 0.2 to 10 wt. % of nonionic surfactant
f) 0.1 to 8 wt. % of enzyme preparation(s)

A further particularly preferred liquid automatic dishwashing agent according to the invention comprises a) 10 to 40 wt. % of citrate b) 1.5 to 10 wt. % of maleic acid homopolymer c) 1 to 8 wt. % of phosphonate d) 0.5 to 8 wt. % of organic solvent e) 0.2 to 10 wt. % of nonionic surfactant f) 0.1 to 8 wt. % of enzyme preparation(s)

Some example formulations for preferred automatic dishwashing agents according to the invention may be found in Tables 7a to 7d below:

| Ingredient | Formulation 1a [wt. %] | Formulation 2a [wt. %] | Formulation 3a [wt. %] | Formulation 4a [wt. %] |
|---|---|---|---|---|
| Citrate | 12 to 50 | 15 to 40 | 12 to 50 | 15 to 40 |
| Anionic copolymer[1] | 2.0 to 20 | 2.0 to 20 | 2.5 to 10 | 2.5 to 10 |
| Carbonate | 0 to 50 | 0 to 30 | 0 to 30 | 0 to 30 |
| Phosphonate | 0 to 8 | 0 to 8 | 0 to 8 | 0 to 8 |
| Nonionic surfactant | 0 to 15 | 0 to 15 | 0 to 8 | 0 to 8 |
| Enzyme preparation(s) | 0 to 12 | 0 to 12 | 0 to 8 | 0 to 8 |
| Org. solvent | 0.1 to 15 | 0.5 to 8 | 0.1 to 15 | 0.5 to 8 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

| Ingredient | Formulation 1b [wt. %] | Formulation 2b [wt. %] | Formulation 3b [wt. %] | Formulation 4b [wt. %] |
|---|---|---|---|---|
| Citrate | 12 to 50 | 15 to 40 | 12 to 50 | 15 to 40 |
| Anionic copolymer[1] | 2.0 to 20 | 2.0 to 20 | 2.5 to 10 | 2.5 to 10 |
| Carbonate | 5 to 50 | 10 to 30 | 5 to 50 | 10 to 30 |
| Phosphonate | 1 to 8 | 1 to 8 | 1.2 to 6 | 1.2 to 6 |
| Nonionic surfactant | 0.1 to 15 | 0.1 to 15 | 0.5 to 8 | 0.5 to 8 |
| Enzyme preparation(s) | 0.1 to 12 | 0.1 to 12 | 0.5 to 8 | 0.5 to 8 |
| Org. solvent | 0.1 to 15 | 0.5 to 8 | 0.1 to 15 | 0.5 to 8 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

[1]anionic polymer b) a copolymer comprising 50 to 90 wt. % of acrylic acid and 10 to 50 wt. % of maleic acid

| Ingredient | Formulation 1c [wt. %] | Formulation 2c [wt. %] | Formulation 3c [wt. %] | Formulation 4c [wt. %] |
|---|---|---|---|---|
| Citrate | 12 to 50 | 15 to 40 | 12 to 50 | 15 to 40 |
| Maleic acid homopolymer | 2.0 to 20 | 2.0 to 20 | 2.5 to 10 | 2.5 to 10 |
| Carbonate | 0 to 50 | 0 to 30 | 0 to 30 | 0 to 30 |
| Phosphonate | 0 to 8 | 0 to 8 | 0 to 8 | 0 to 8 |
| Nonionic surfactant | 0 to 15 | 0 to 15 | 0 to 8 | 0 to 8 |
| Enzyme preparation(s) | 0 to 12 | 0 to 12 | 0 to 8 | 0 to 8 |
| Org. solvent | 0.1 to 15 | 0.5 to 8 | 0.1 to 15 | 0.5 to 8 |
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

| Ingredient | Formulation 1d [wt. %] | Formulation 2d [wt. %] | Formulation 3d [wt. %] | Formulation 4d [wt. %] |
|---|---|---|---|---|
| Citrate | 12 to 50 | 15 to 40 | 12 to 50 | 15 to 40 |
| Maleic acid homopolymer | 2.0 to 20 | 2.0 to 20 | 2.5 to 10 | 2.5 to 10 |
| Carbonate | 5 to 50 | 10 to 30 | 5 to 50 | 10 to 30 |
| Phosphonate | 1 to 8 | 1 to 8 | 1.2 to 6 | 1.2 to 6 |
| Nonionic surfactant | 0.1 to 15 | 0.1 to 15 | 0.5 to 8 | 0.5 to 8 |
| Enzyme preparation(s) | 0.1 to 12 | 0.1 to 12 | 0.5 to 8 | 0.5 to 8 |
| Org. solvent | 0.1 to 15 | 0.5 to 8 | 0.1 to 15 | 0.5 to 8 |

-continued

| Ingredient | Formulation 1d [wt. %] | Formulation 2d [wt. %] | Formulation 3d [wt. %] | Formulation 4d [wt. %] |
|---|---|---|---|---|
| Silicate | — | — | — | — |
| Phosphate | — | — | — | — |
| Bleaching agent | — | — | — | — |
| Misc. | Ad 100 | Ad 100 | Ad 100 | Ad 100 |
| pH (10% soln.; 20° C.) | 8 to 12 | 8 to 12 | 8 to 12 | 8 to 12 |

The automatic dishwashing agents according to the invention may assume presentation forms known to a person skilled in the art, thus for example not only as solid or liquid forms but also as combination solid and liquid presentations.

Suitable solid presentations are in particular powders, granules, extrudates or compacted products, in particular tablets. The liquid presentations based on water and/or organic solvents may be thickened, assuming gel form.

Agents according to the invention may be formulated as monophasic or multiphasic products. Preferred automatic dishwashing agents are in particular those with one, two, three or four phases. Automatic dishwashing agents which are characterized in that they assume the form of a prefabricated dispensing unit with two or more phases are particularly preferred.

The individual phases of multiphasic agents may be of identical or different states of aggregation. Preferred automatic dishwashing agents are in particular those which comprise at least two different solid phases and/or at least two liquid phases and/or at least one solid and at least one liquid phase. Bi- or multiphasic tablets are particularly preferred, for example bilayer tablets, in particular bilayer tablets with a recess and a molding located in the recess.

Automatic dishwashing agents according to the invention are preferably preformulated as dispensing units. These dispensing units preferably comprise the quantity of substances with a washing or cleaning action required for a washing operation. Preferred dispensing units have a weight of between 12 and 30 g, preferably of between 14 and 26 g and in particular of between 15 and 22 g.

The volume of the above-stated dispensing units and their three-dimensional shape are particularly preferentially selected such that the preformulated units can be dispensed by means of the dispensing chamber of a dishwashing machine. The volume of the dispensing unit therefore preferably amounts to between 10 and 35 ml, preferably between 12 and 30 ml and in particular between 15 and 25 ml.

The automatic dishwashing agents according to the invention, in particular the prefabricated dispensing units, particularly preferentially comprise a water-soluble covering.

Disintegration of the prefabricated moldings may be facilitated by incorporating disintegration auxiliaries or "tablet disintegrants" into these agents in order to shorten disintegration times.

These substances, known as disintegrants due to their mode of action, increase in volume on exposure to water, resulting, on the one hand, in an increase of their own volume (swelling) and, on the other hand, possibly also in generation of pressure due to the release of gases, causing the tablet to break up into smaller particles. Disintegration auxiliaries which have long been known are for example carbonate/citric acid systems, it also being possible to use other organic acids. Swelling disintegration auxiliaries are for example synthetic polymers such as polyvinylpyrrolidone (PVP) or natural polymers or modified natural materials such as cellulose and starch and the derivatives thereof, alginates or casein derivatives.

Disintegration auxiliaries are preferably used in quantities of 0.5 to 10 wt. %, preferably of 3 to 7 wt. % and in particular of 4 to 6 wt. %, in each case relative to the total weight of the agent containing the disintegration auxiliary.

Preferably used disintegration agents are those based on cellulose, such that preferred washing or cleaning agents contain such a cellulose-based disintegration agent in quantities of 0.5 to 10 wt. %, preferably of 3 to 7 wt. % and in particular of 4 to 6 wt. %. The cellulose used as a disintegration auxiliary is preferably not used in finely divided form, but is instead converted into a coarser form, for example is granulated or compacted, before being mixed into the premixes which are to be pressed. The particle sizes of such disintegration agents are for the most part above 200 μm, at least 90 wt. % preferably being between 300 and 1600 μm and in particular at least 90 wt. % being between 400 and 1200 μm.

Preferred disintegration auxiliaries, preferably a cellulose-based disintegration auxiliary, preferably in granular, cogranulated or compacted form, are present in the agent containing the disintegration agent in quantities of 0.5 to 10 wt. %, preferably of 3 to 7 wt. % and in particular of 4 to 6 wt. %, in each case relative to the total weight of the agent containing the disintegration agent.

Gas-evolving effervescent systems may furthermore preferably be used according to the invention as tablet disintegration auxiliaries. Preferred effervescent systems, however, consist of at least two components which react together with formation of gas, for example of alkali metal carbonate and/or hydrogencarbonate and an acidifying agent which is suitable for releasing carbon dioxide from the alkali metal salts in aqueous solution. An acidifying agent which releases carbon dioxide from the alkali metal salts in aqueous solution is for example citric acid.

The previously described active ingredient combinations are in particular suitable for cleaning dishes in automatic dishwashing methods. The present application further provides a method of cleaning dishes in a dishwashing machine using an automatic dishwashing agent according to the invention, the automatic dishwashing agent preferably being dispensed into the interior of a dishwashing machine during the performance of a dishwashing program, before the start of the main washing cycle or in the course of the main washing cycle. Dispensing or introduction of the agent according to the invention into the interior of the dishwashing machine may proceed manually, but the agent is preferably dispensed into the interior of the dishwashing machine by means of the dispensing chamber of the dishwashing machine. Preferably, no additional water softener and no additional rinse aid is dispensed into the interior of the dishwashing machine in the course of the cleaning method. The present application also provides a kit for a dishwashing machine, comprising a) an automatic dishwashing agent according to the invention;

b) instructions which instruct the consumer to use the automatic dishwashing agent without addition of a rinse aid and/or a water-softening salt.

The automatic dishwashing agents according to the invention in particular also exhibit their advantageous cleaning and drying characteristics in low temperature cleaning methods. Preferred dishwashing methods using agents according to the invention are therefore characterized in that the dishwashing methods are carried out at a liquor temperature of below 60° C., preferably of below 50° C.

As described above, agents according to the invention are distinguished by improved tea cleaning in comparison with conventional automatic dishwashing agents. The present application accordingly also provides the use of an automatic dishwashing agent according to the invention for improving tea cleaning in automatic dishwashing.

EXAMPLES

I. Using an automatic dishwashing method, soiled dishes were washed in a dishwashing machine (Miele G 698) at a water hardness of 21 German hardness degrees and a temperature of 50° C. with 42.5 g ml of the automatic dishwashing agents listed in the following table.

| Ingredient | Comp. 1 | Comp. 2 | Comp. 3 | Comp. 4 | Inv. 1 | Inv. 2 | Inv. 3 |
|---|---|---|---|---|---|---|---|
| | Values stated in wt. % | | | | | | |
| Potassium tripolyphosphate | 18 | — | — | — | — | — | — |
| Silicate | | 18 | | | | | |
| Sodium citrate | — | — | 18 | 18 | 18 | 18 | 18 |
| Acrylic acid homopolymer | — | — | — | 2.0 | — | — | — |
| Anionic copolymer[1] | — | — | — | — | 2.8 | 4.5 | 6.9 |
| Sulfopolymer[2] | 4.2 | — | — | — | — | — | — |
| Sulfopolymer[3] | — | 4.2 | 4.2 | 4.2 | 4.2 | 4.2 | 4.2 |
| Sodium carbonate | 4.0 | 4.0 | 4.0 | 4.0 | 4.0 | 4.0 | 4.0 |
| HEDP | 1.5 | 1.5 | 1.5 | 1.5 | 1.5 | 1.5 | 1.5 |
| Nonionic surfactant | 2.0 | 2.0 | 2.0 | 2.0 | 2.0 | 2.0 | 2.0 |
| Protease preparation | 2.0 | 2.0 | 2.0 | 2.0 | 2.0 | 2.0 | 2.0 |
| Amylase preparation | 0.8 | 0.8 | 0.8 | 0.8 | 0.8 | 0.8 | 0.8 |
| Alkanolamine | 1.5 | 1.5 | 1.5 | 1.5 | 1.5 | 1.5 | 1.5 |
| Water, misc. | Ad 100 | Ad 100 | Ad 100 | Ad 100 | Ad 100 | Ad 100 | Ad 100 |
| pH (10% solution, 20° C.) | 10.3 | 10.6 | 10.5 | 10.4 | 10.4 | 10.4 | 10.3 |

[1]anionic copolymer comprising i) unsaturated monocarboxylic acid(s) A ii) unsaturated dicarboxylic acid(s) B.

[2]sulfonic acid-containing copolymer comprising i) unsaturated carboxylic acid(s) ii) unsaturated sulfonic acid group-containing monomer(s)

[3]hydrophobically modified sulfonic acid-containing copolymer comprising i) unsaturated carboxylic acid(s) ii) unsaturated sulfonic acid group-containing monomer(s) iii) further nonionogenic monomer(s)

The cleaning performance of the automatic dishwashing agents was evaluated using the IKW method. The results are stated in the following table (the stated values are averages from 3 tests)

| Cleaning performance | Comp. 1 | Comp. 2 | Comp. 3 | Comp. 4 | Inv. 1 | Inv. 2 | Inv. 3 |
|---|---|---|---|---|---|---|---|
| Tea | 3.9 | 0.2 | 1.7 | 0.3 | 4.1 | 4.3 | 4.2 |
| Starch | 9.1 | 7.7 | 9.0 | 7.7 | 9.1 | 9.1 | 9.4 |
| Minced meat | 10.0 | 9.5 | 10.0 | 10.0 | 10.0 | 10.0 | 10.0 |

(Evaluation scale for cleaning performance: 10 = no dirt to 0 = severe dirt)

II. Using an automatic dishwashing method, soiled dishes were washed in a dishwashing machine (Miele G 698) at a water hardness of 21 German hardness degrees and a temperature of 50° C. with 41 g ml of the automatic dishwashing agents listed in the following table.

| Ingredient | Comp. 1 | Inv. 1 |
|---|---|---|
| | Values stated in wt. % | |
| Sodium citrate | 8.0 | 8.0 |
| Acrylic acid homopolymer | 12 | — |
| Maleic acid homopolymer | — | 12 |
| Sulfopolymer | 9.5 | 9.5 |
| Sodium carbonate | 5.0 | 5.0 |
| Potassium hydroxide | 9.5 | 9.5 |
| HEDP | 1.5 | 1.5 |
| Nonionic surfactant | 2.0 | 2.0 |
| Protease preparation | 2.4 | 2.4 |
| Amylase preparation | 0.6 | 0.6 |
| 1,2-Propylene glycol | 5.6 | 5.6 |
| Water, misc. | Ad 100 | Ad 100 |
| pH (10% solution, 20° C.) | 10.4 | 10.4 |

The cleaning performance of the automatic dishwashing agents was evaluated using the IKW method. The results are stated in the following table (the stated values are averages from 5 tests)

| Cleaning performance | Comp. 1 | Inv. 1 |
|---|---|---|
| Tea | 0.2 | 2.0 |

(Evaluation scale for cleaning performance: 10 = no dirt to 0 = severe dirt)

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A low-alkali, phosphate- and bleaching agent-free automatic dishwashing agent with a pH value (10% solution; 20° C.) of between 8 and 12 consisting essentially of:

a) 10 to 60 wt. % of citrate;

b) 2.0 to 30 wt. % of anionic polymer selected from the group consisting of maleic acid homopolymer and copolymers of acrylic acid and maleic acid with a relative molecular mass, relative to free acids, of 2000 to 70000 g/mol.;

c) 0.1 to 15 wt. % nonionic surfactant;

d) 0.1 to 15 wt. % organic solvent; and e) 0.1 to 12 wt. % enzyme preparation.

2. The automatic dishwashing agent according to claim 1, wherein the automatic dishwashing agent contains no silicate.

3. The automatic dishwashing agent according to claim 1, wherein the automatic dishwashing agent has a pH value (20° C.) of between 9 and 11.5.

4. The automatic dishwashing agent according to claim 1, wherein the automatic dishwashing agent contains, relative to the total weight thereof, 12 to 50 wt. % of citrate.

5. The automatic dishwashing agent according to claim 1, wherein the automatic dishwashing agent contains, relative to the total weight thereof, 2.0 to 20 wt. % of the anionic polymer.

6. A method for cleaning dishes in a dishwashing machine using an automatic dishwashing agent according to claim 1.

7. The method according to claim 6, wherein the method is carried out at a liquor temperature of below 60° C.

8. A method for cleaning dishes soiled by tea using an automatic dishwashing agent according to claim 1.

* * * * *